US007473860B2

(12) United States Patent
Sample

(10) Patent No.: US 7,473,860 B2
(45) Date of Patent: Jan. 6, 2009

(54) AUTOCLAVABLE SWITCH ASSEMBLY

(75) Inventor: Philip B. Sample, Wakefield, MA (US)

(73) Assignee: Smith & Nephew, Inc., Memphis, TN (US)

( * ) Notice: Subject to any disclaimer, the term of this patent is extended or adjusted under 35 U.S.C. 154(b) by 19 days.

(21) Appl. No.: 11/747,123

(22) Filed: May 10, 2007

(65) Prior Publication Data

US 2008/0276453 A1 Nov. 13, 2008

(51) Int. Cl.
*H01H 9/00* (2006.01)

(52) U.S. Cl. ..... 200/302.1; 200/302.2; 200/302.3

(58) Field of Classification Search ..... 200/511–517
See application file for complete search history.

(56) References Cited

U.S. PATENT DOCUMENTS 4,046,975 A * 9/1977 Seeger, Jr. ..... 200/515
4,415,780 A * 11/1983 Daugherty et al. ..... 200/5 A
4,916,262 A * 4/1990 Jungels-Butler et al. .... 200/5 A
5,512,721 A * 4/1996 Young et al. ..... 200/512
5,561,278 A * 10/1996 Rutten ..... 200/5 A
5,959,557 A 9/1999 Lim
6,441,330 B2 * 8/2002 Liao ..... 200/515
6,617,536 B2 * 9/2003 Kawaguchi ..... 200/516
6,841,748 B2 * 1/2005 Serizawa et al. ..... 200/512
6,924,447 B2 * 8/2005 Lu et al. ..... 200/515
6,982,394 B2 * 1/2006 Ide et al. ..... 200/516
2005/0253254 A1 11/2005 Neogi et al.

OTHER PUBLICATIONS

Spectra Symbol Corp., Membrane Switch Design Guide, http://www.spectrasymbol.com/designguide.pdf.
Tapecon Membrane Switch Division, Membrane Switch Designer's Reference Guide, http://www.tapecon.com/ftp_only/membrane.reference.pdf.
Arthrotek, IES 1000 Arthroscopy System, 1999.
Smith & Nephew, Inc., 2007 Product Catalog, DYONICS(R) 25 Fluid Management System, DYONICS (R) 25 Remote Control, pp. F2-F3, Jan. 2007.
Photographs illustrating top, bottom, and assembly views of PCB assembly used in Smith & Nephew, Inc. DYONICS(R) 25 Fluid Management System Remote Control (see Desig. AM ID, p. F-3).

* cited by examiner

*Primary Examiner*—Michael A Friedhofer
(74) *Attorney, Agent, or Firm*—Norman F. Hainer, Jr.

(57) ABSTRACT

A device includes a printed circuit board having a first surface and a second surface. The printed circuit board defines an opening therethrough from the first surface to the second surface and a circuit formed on the first surface of the printed circuit board with no portion of the circuit intersecting the opening. The second surface of the printed circuit board at least partially bounds a first channel in fluid communication with the opening. A method of venting includes displacing air within a cavity of a switch by moving the air through one or more channels formed in a layer defining cut-outs in fluid communication with the cavity. The air is moved through an opening formed in a printed circuit board. The layer is positioned at a first side of the printed circuit board. In addition, the method includes moving the air through a venting channel positioned at a second, opposite side of the printed circuit board and into the surrounding environment.

18 Claims, 5 Drawing Sheets

AUTOCLAVABLE SWITCH ASSEMBLY

TECHNICAL FIELD

This invention relates to an autoclavable switch assembly.

BACKGROUND

During a surgical procedure, remote hand controls including a series of switches built upon a printed circuit board are typically used to control surgical devices located in a non-sterile area of the operating room but that require control from the sterile field where a patient is located. The remote controls are sterilized by autoclaving after each use. In order to withstand repeated autoclave cycles, the switches and printed circuit board are generally sealed in an autoclave resistant housing. However, during switch operation, air often becomes trapped in a cavity of the switch. For the switch to function properly, the air is generally vented via air flow channels connecting the cavities and through vent holes connecting the channels to an environment external to the PCB but internal on the remote control assembly.

SUMMARY

The venting of air from the switch cavities increases the chance of failure of the printed circuit board circuitry because contaminants, such as water, can enter via the vent holes and contact the circuitry, causing shorts or other failures. Such damage can be limited by minimizing the number of vent holes, placing the circuitry on only one side of the printed circuit board, and providing a tortuous air flow channel that not only eliminates any direct path for the contaminants to travel to the circuitry but also acts to trap the contaminants in the channel. By limiting the damaging effects of contaminants, the present assemblies and techniques provide a surgical team with a remote control assembly that can withstand a commercially-acceptable number of autoclave cycles, for example, between approximately 500 and 1000 autoclave cycles without failure.

In one general aspect, a device includes a printed circuit board having a first surface and a second, surface. The printed circuit board defines an opening therethrough from the first surface to the second surface and a circuit formed on the first surface of the printed circuit board with no portion of the circuit intersecting the opening. The second surface of the printed circuit board at least partially bounds a first channel in fluid communication with the opening.

Implementations may include one or more of the following features. For example, a spacer layer is coupled to the first surface of the printed circuit board. The spacer layer defines a second channel in fluid communication with the opening in the printed circuit board and the first channel. The circuit includes a selectively activatable switch contact for completing an electrical circuit.

In addition, a set of solder pads are disposed on the second surface of the printed circuit board that provide termination points for the circuit. The first channel is formed in the second surface of the printed circuit board. The first channel includes a tortuous configuration and the first channel limits contact between contaminants and the circuit thereby enabling the device to be autoclaved.

In addition, a vent layer is coupled to the second surface of the printed circuit board. The vent layer defines a cutout therethrough that cooperates with the second surface of the printed circuit board to bound the first channel. A vent layer cover is coupled to the vent layer and defines an opening therethrough. The opening is in fluid communication with the first channel and the vent layer cover cooperates with the cutout and the second surface of the printed circuit board to bound the first channel.

A set of switch contacts are arranged in a predetermined pattern on the first surface of the printed circuit board, and a set of selectively activatable switches, are disposed within the spacer layer. Each one of the set of selectively activatable switches is positioned relative to a respective one of the set of switch contacts for activating the respective one of the switch contacts.

The second channel includes a set of cutout portions that overlay the set of switch contacts and a set of pathways extending between the set of cutout portions so that the set of pathways do not intersect the circuit. The first channel and the second channel cooperate to limit contact between contaminants and the circuit thereby enabling the device to be autoclaved.

The device further includes a cover layer coupled to the spacer layer to retain the set of selectively activatable switches in position within the spacer layer. The set of selectively activatable switches are dome switches that include gold plated stainless steel domes.

In another general aspect, a device includes a printed circuit board having a first surface and a second surface and a circuit traversing only the first surface of the printed circuit board. A selectively activatable switch is positioned relative to the circuit. The second surface of the printed circuit board at least partially bounds a channel in fluid communication with the selectively activatable switch.

Implementations may include one or more of the following features. For example, the device includes a resilient keypad including a button positioned relative to the selectively activatable switch for activating the selectively activatable switch.

In another general aspect, a method of venting includes displacing air within a cavity of a switch by moving the air through one or more channels formed in a layer defining cut-outs in fluid communication with the cavity. The air is moved through an opening formed in a printed circuit board. The layer is positioned at a first side of the printed circuit board. In addition, the method includes moving the air through a venting channel positioned at a second, opposite side of the printed circuit board and into the surrounding environment.

Implementations may include one or more of the following features. For example, the venting channel has a tortuous configuration.

Advantages can include limiting the exposure of the printed circuit board circuitry from any external penetration of contaminants; minimizing the number of vent access holes while maintaining ability to provide for venting of remote switches; providing solder pads on one side of a printed circuit board; reducing the pumping effect of switches alternating from pressure to vacuum by increasing the distance of the vent pathway; eliminating the solder mask from printed circuit board thereby eliminating exposure of circuitry as a result of degradation of the mask during autoclave cycles; and increasing spacing of circuit traces and solder pads reducing potential shorts.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
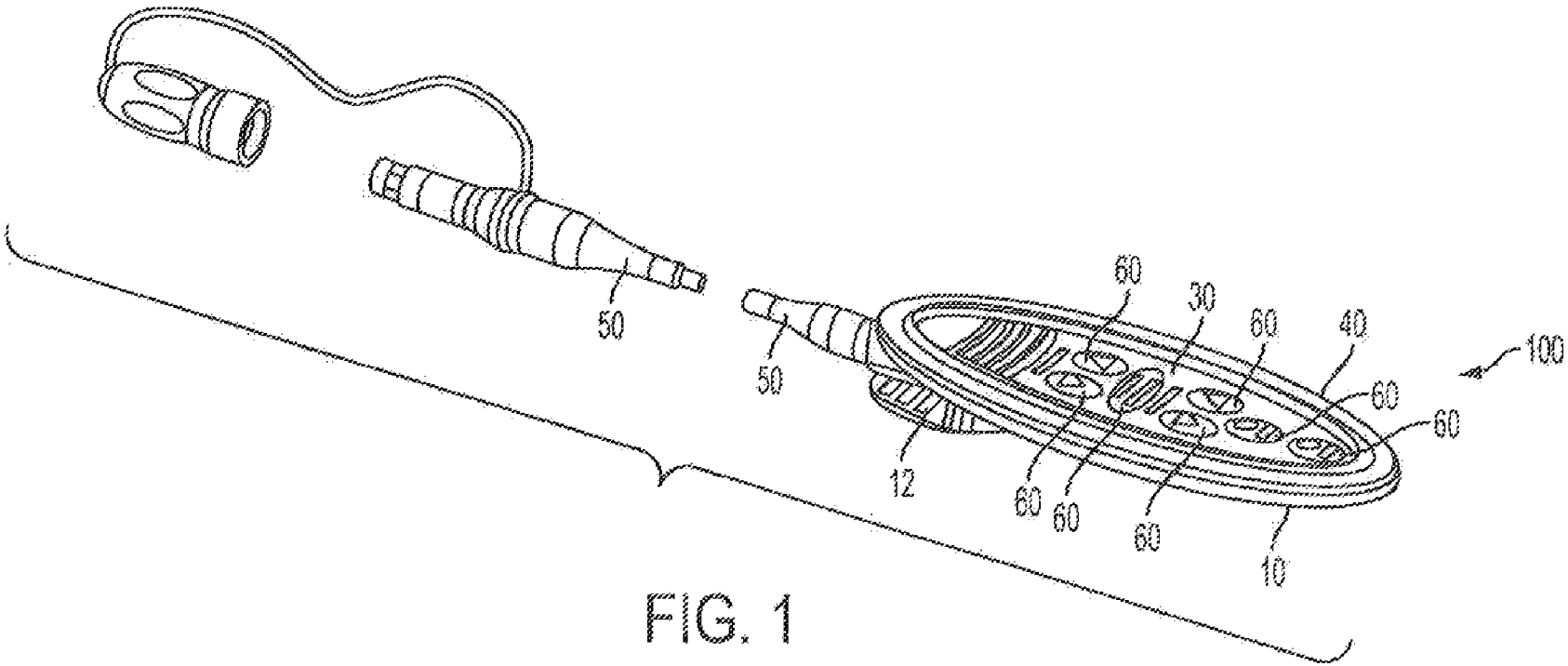
FIG. 1 is an illustration of an autoclavable electronic device.
Figure 2:
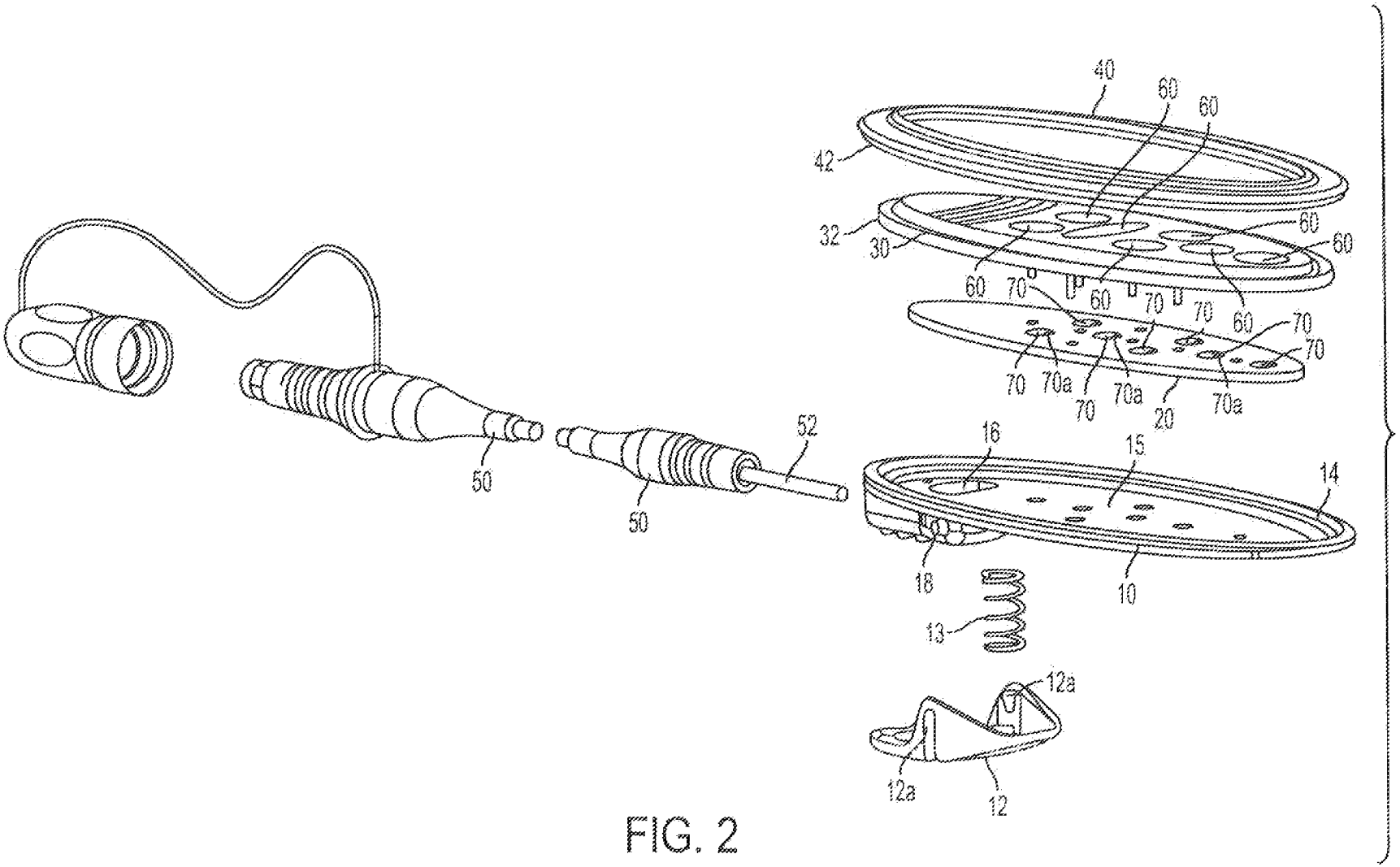
FIG. 2 is an exploded view of the remote control of FIG. 1.

Referring to FIGS. 1 and 2, an autoclavable switch assembly, for example, a remote control 100 includes a set of buttons 60 and associated switches 70 for manually operating a surgical device (not shown). The switches close circuits 205 (FIG. 3) on a printed circuit board (PCB) assembly 20 to provide the control signals for the surgical device. The switches are activated by a keypad 30. The PCB assembly 20 and the keypad 30 are sealed within a base 10 and a bezel 40. Signals from the remote control 100 to the surgical device are communicated via a cable assembly 50. Alternatively, signals can be transmitted wirelessly.

Figure 3:
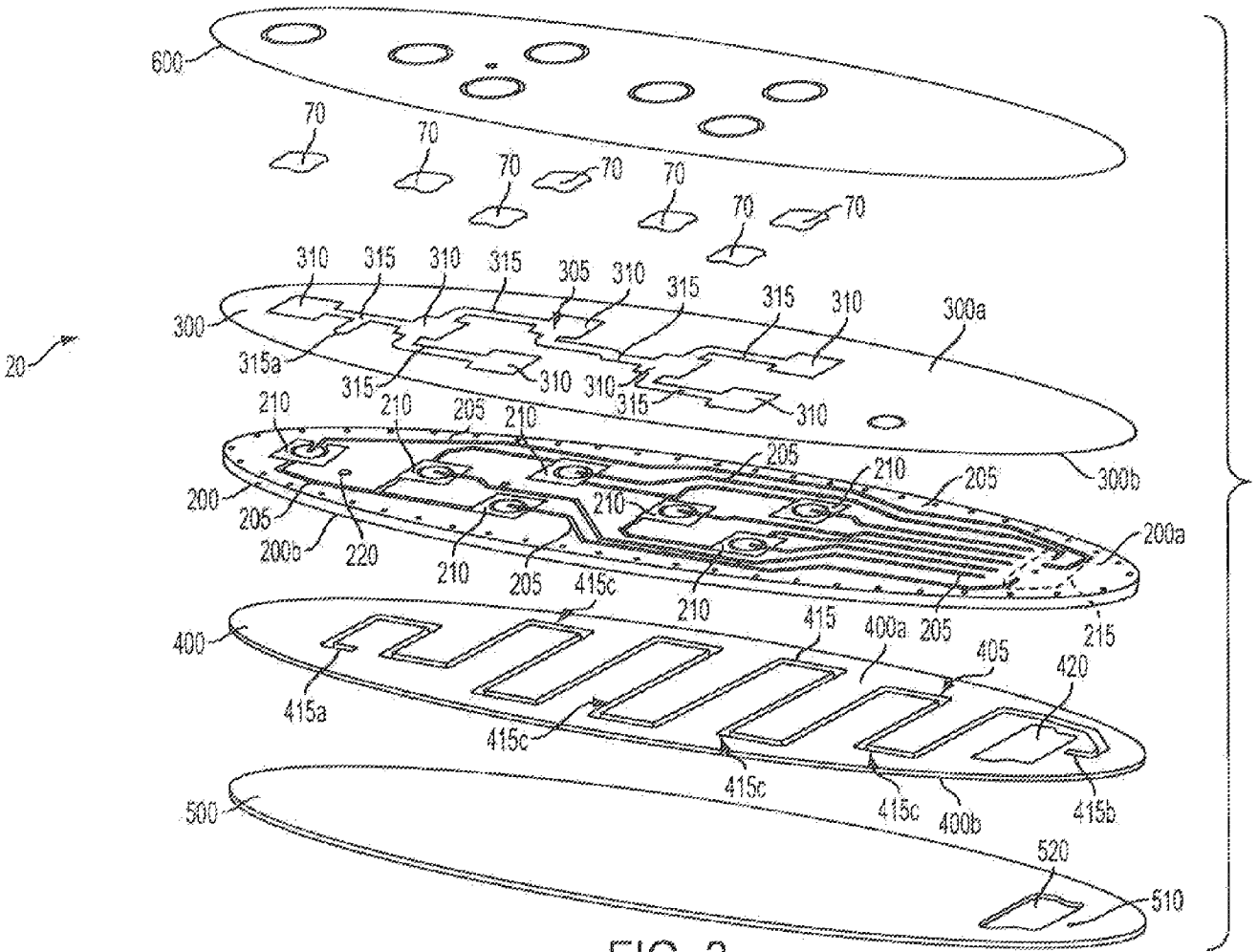
FIG. 3 is an exploded view of a printed circuit board assembly of the electronic device of FIG. 1.

Referring to FIG. 3, the PCB assembly 20 includes a printed circuit board (PCB) 200 sandwiched between a spacer layer 300 and a vent layer 400. The PCB 200, spacer layer 300, and vent layer 400 are sealed between a vent layer cover 500 and a switch cover 600.

The PCB 200 includes a first surface 200*a* and a second surface 200*b*. The circuits 205 are formed by, for example, chemical etching, on the first surface 200*a* of the PCB 200 in a desired pattern. The set of circuits 205 each traverse the first surface 200*a* and pass through a portion of the PCB 200 where they each terminate at one of a set of solder pads 215 (FIG. 4) disposed on the second surface 200*b* of the PCB 200. In this implementation, the set of circuits 205 do not traverse the second surface 200*b*. Each of the pads in the set of solder pads 215 is coupled to a corresponding control wire 52 of the cable assembly 50 and is coated with a high temperature autoclavable epoxy. The circuits 205 include switch contacts 210 arranged in a predetermined pattern within the circuits 205. The switch contacts 210 cooperate with respective switches 70 to close electrical circuits. The PCB 200 also defines an opening 220 therethrough that extends from the first surface 200*a* to the second surface 200*b*. The opening 220 is in fluid communication with the spacer layer 300 and the vent layer 400 to provide a vent pathway, as described in more detail below. In this implementation, the PCB 200 is made from FR4 laminates with gold plating and without a conventional solder mask on the lower surface 200*b*.

Figure 5:
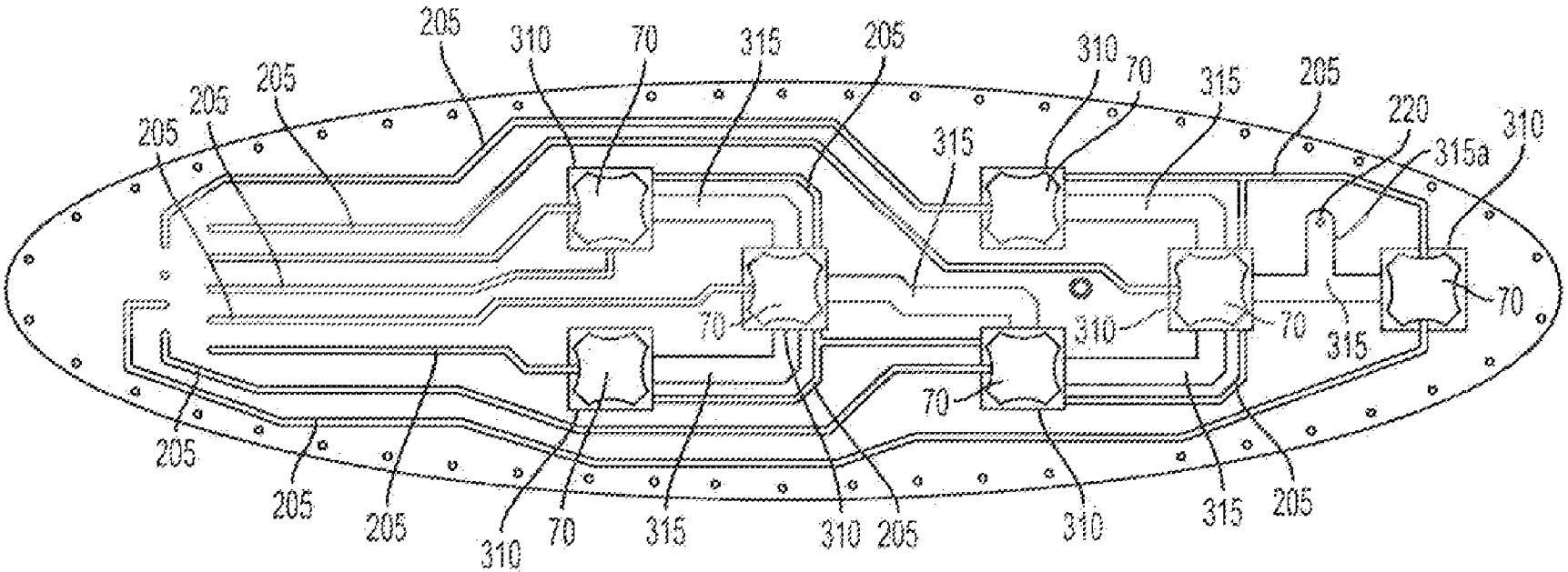
FIG. 5 is a top view of the assembled printed circuit board assembly of FIG. 3 without the cover.

The spacer layer 300 is coupled to the first surface 200*a* of the PCB 200. The spacer layer 300 includes a first surface 300*a* and a second surface 300*b* facing the first surface 200*a* of the PCB 200, and an acrylic adhesive disposed on the first and second surfaces 300*a*, 300*b*. When the spacer layer 300 is brought into contact with the PCB 200, and more particularly, the second surface 300*b* of the spacer layer 300 is brought into contact with the first surface 200*a* of the PCB 200, the acrylic adhesive acts to form a sealing bond between the spacer layer 300 and the PCB 200. The spacer layer 300 defines a channel 305 that includes cutout portions 310 and pathways 315 extending between the cutout portions 310. The cutout portions 310 overlay the pre-arranged pattern of the switch contacts 210 formed on the first surface 200*a* of PCB 200 and receive a respective one of the switches 70. As shown in FIG. 5, the set of pathways 315 are formed in the spacer layer 300 such that when the spacer layer 300 is disposed on the PCB 200, the set of pathways 315 do not overlap, intersect, or overlay any of the set of circuits 205. This configuration limits the potential for contaminants to damage the set of circuits 205 as will be explained in more detail below. As further shown in FIGS. 3 and 5, a portion 315*a* of the set of pathways 315 overlays the opening 220 of the PCB 200 and is in fluid communication with the opening 220 when the spacer layer 300 is disposed on the PCB 200.

Figure 4:
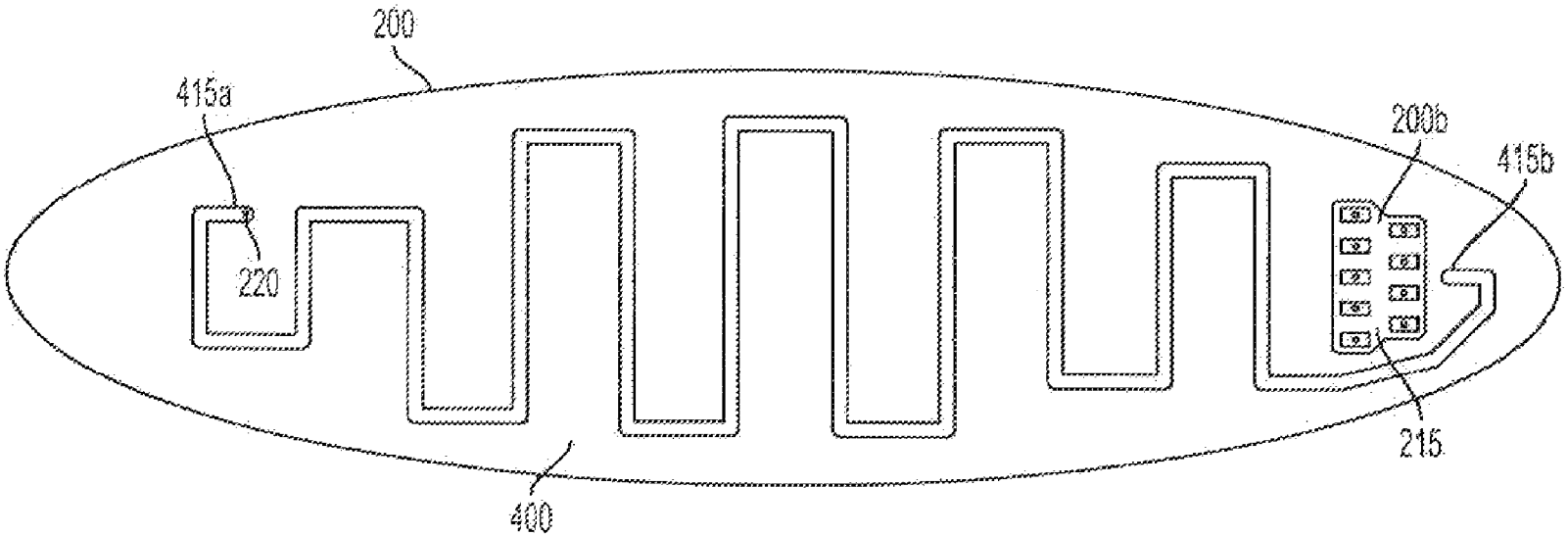
FIG. 4 is bottom view of the assembled printed circuit board assembly of FIG. 3 without the vent layer cover.

Referring to FIGS. 3 and 4, the vent layer 400 is coupled to the second surface 200*b* of the PCB 200. The vent layer 400 includes a first surface 400*a* and a second surface 400*b* each having an acrylic adhesive disposed thereon. As such, when the vent layer 400 is brought into contact with the PCB 200, and more particularly, the first surface 400*a* of the vent layer 400 is brought into contact with the second surface 200*b* of the PCB 200, the acrylic adhesive acts to form a sealing bond between the vent layer 400 and the PCB 200. The vent layer 400 further defines a cutout 405 that extends from the first surface 400*a* to and through the second surface 400*b* and that forms a channel 415.

The channel 415 includes a first end 415*a* that overlays, and is in fluid communication with, the opening 220 formed in the PCB 200, and a second end 415*b* that is in fluid communication with an opening 510 formed in the vent layer cover 500. The opening 510 is in fluid communication with the environment surrounding the PCB assembly 20, which is the interior of the remote control 100 in this exemplary implementation defined by the base 10, the bezel 40, and the keypad 30. The opening 510 represents the sole opening for the PCB assembly 20 in direct fluid communication with the environment. The vent layer cover 500 is coupled to the second surface 400*b* using the acrylic adhesive disposed on the second surface 400*b* of the vent layer 400. The vent layer 400 and the vent layer cover 500 each further define openings 420 and 520, respectively, which are configured to overlay the set of solder pads 215 and to provide a passageway for the control wires 52 therethrough. The acrylic adhesive used to couple the vent layer cover 500 to the vent layer 400 and the vent layer 400 to the second surface 200*b* of the PCB 200 forms a fluid-tight seal around the openings 420 and 520 so that there is no fluid communication between the PCB assembly 20 and the environment via the openings 420 and 520. The vent layer cover 500 is made from a polyester or other suitable material.

Referring to FIGS. 3 and 5, the set of switches 70 are received within the set of cutout portions 310 of the spacer layer 300 and are free to move within the set of cutout portions 310 prior to disposition of the cover 600 on the spacer layer 300. The cover 600, which may be made from, for example, a polyester covered with a screened silver, retains the set of switches 70 in position within the spacer layer 300 and in position relative to a respective one of the set of switch contacts 210, as illustrated in FIG. 5. Exemplary switches for use in this implementation include tactile, gold-plated, stainless steel dome switches, however, other suitable switches may be used. The use of gold-plating has been found to enhance the corrosion resistance of the set of switches 70, to make the set of switches 70 less susceptible to retaining deposits, such as fluorides, during autoclave cycles, and to provide increased switch continuity.

As shown in FIG. 2, the keypad 30, made, for example, from a resilient rubber, elastomer, or other suitable material, overlays the PCB assembly 20 in the remote control 100. The keypad 30 includes the buttons 60 each of which is positioned over and relative to a respective one of the switches 70 for selectively activating the switch. For example, each of the buttons 60 can represent various functions (in a pump, for example), such as, power on/off, flow up/down, pressure up/down, etc.

The base 10 cooperates with the keypad 30 and the bezel 40 to seal the PCB assembly 20 within an interior of the remote control 100. To provided this seal, the base 10 includes a set of peripheral grooves and protrusions 14 that mate with a set of corresponding grooves and protrusions 32, 42 formed on the keypad 30 and the bezel 40. The base 10 also defines a cavity 16 that receives a set of control wires 52 of the cable assembly 50. The control wires 52 carry control information from the electronic device 100 to the surgical device in a conventional manner. The base 10 further defines an area 15 configured to receive the PCB assembly 20 upon assembly of the remote control 100. When the PCB assembly 20 is assembled into the base 10, the vent opening 510 is positioned over the cavity 16 so that an air gap exists between the bottom of the cavity (not shown) and the vent opening 510. Such placement limits direct contact by contaminants with the vent opening 510 in the event that water or other contaminants migrate through the seal and accumulate in the cavity 16.

Referring again to FIG. 1, a clip 12 cooperates with the base 10 to provide a user with a convenient way to attach the remote control 100 to a desired attachment point, such as a patient's drape, a post, or other suitable location. The clip 12 has openings 12*a*, and the base 10 includes protrusions 18, one of which is shown in FIG. 2, that cooperate with the openings 12*a* and a spring 13 to pivotally mount the clip 12 to the base 10.

The PCB 200, the spacer layer 300, the vent layer 400, and the vent layer cover 500 cooperate to form a fluid communication pathway between each of the set of switches 70 and the external environment of the PCB assembly 20 such that air within a switch cavity 70*a*, which is a cavity formed between the switch 70 and the PCB 200, can be displaced and vented and the pressure equalized with the surrounding environment to permit the set of switches 70 to close properly. In the present exemplary implementation, the channel 305 of the spacer layer 300 is in fluid communication with the opening 220 defined by the PCB 200, which is in turn in fluid communication with the channel 415 defined by vent layer 400. The channel 415 is in turn in fluid communication with the opening 510 defined by the vent layer cover 500, which is in turn in fluid communication with the surrounding environment of the PCB assembly 20, which is the interior of the remote control 100 in this implementation. Accordingly, when one of the set of switches 70 is activated, air within the switch 70, and more particularly, within a cavity 70*a* of the switch 70, can move through the channel 305 of the spacer layer 300, through the opening 220 formed in the printed circuit board 200, through the channel 415, and out the opening 510 to the surrounding environment. Venting each of the set of switches 70 in this manner allows the pressure within each of the set of switches 70 to be equalized with the surrounding environment.

The configuration of the vent channels in the instant implementation not only allows for switch closure but it also acts to limit the contamination of, and substantially extend the life of the PCB assembly 20, and as a result the life of the remote control 100, following multiple autoclave cycles. The keypad 30 of the remote control 100 acts to seal the PCB assembly 20 within the remote control 100 as discussed above. However, after a number of autoclave cycles, the seal between the bezel 40 and the base 10 can degrade and water or other contaminants enter the interior portion of the remote control 100. If this occurs, these contaminants can eventually enter the opening 510 defined by the vent layer cover 500, migrate along the channel 415 and eventually make there way to the circuits 205, and more specifically, the set of switch contacts 210 via the pathways 315. However, because of the configuration of the channel 415, which as shown in FIG. 3 comprises a tortuous configuration including a number of repeated turns or bends 415*c* along a circuitous path, and the channel 305, and the fact that the set of pathways 315 do not intersect any of the set of circuits 205, there is a long pathway between the opening 510 and the circuits 205, with no direct path to the circuits 205 as a result. Therefore, the contaminants entering through the opening 510 tend to become trapped primarily within the tortuous channel 415 defined by the vent layer 400, and secondarily, within the set of pathways 315 defined by the spacer layer 300 rather than reaching the set of circuits 205.

A number of implementations of the invention have been described. Nevertheless, it will be understood that various modifications may be made without departing from the spirit and scope of the invention. For example, while the tortuous channel 415 of the vent layer 400 has been illustrated as a separate layer coupled to the second surface 200*b* of the PCB 200, the channel 415 may be formed directly in the second surface 200*b* of the PCB 200. Although the PCB 200 has been described as being made from FR4 laminates with gold plating and without a conventional solder mask, other suitable laminates, such as CEM1 or CEM3, and configurations are possible. Acrylic adhesives have been described for use on the spacer layer 300 and the vent layer 400, but other suitable adhesives, such as epoxies, or other suitable materials may be used. In addition, although opening 220 is shown positioned in PCB 200 such that it fluidly communicates with the portion 315*a* of the pathways 315 and the first end 415*a* of channel 415, opening 220 may be positioned at other locations in PCB 200. For example, the opening 220 can be positioned to fluidly communicate with any one of the set of pathways 315 (FIG. 3) so long as the opening 220 is also in fluid communication with the channel 415. Accordingly, other embodiments are within the scope of the following claims.

What is claimed is:

1. A device comprising:

a printed circuit board having a first surface and a second surface and defining an opening therethrough; and a circuit formed on the first surface of the printed circuit board with no portion of the circuit intersecting the opening, wherein the circuit board includes a first channel formed in the second surface of the circuit board and in fluid communication with the opening.

2. The device of claim 1, further comprising a spacer layer coupled to the first surface of the printed circuit board and defining a second channel in fluid communication with the opening in the printed circuit board.

3. The device of claim 1, wherein the circuit includes a selectively activatable switch contact for completing an electrical circuit.

4. The device of claim 1, further comprising a set of solder pads disposed on the second surface of the printed circuit board, wherein the set of solder pads provide a termination point for the circuit.

5. The device of claim 1, further comprising a vent layer coupled to the second surface of the printed circuit board and defining a cutout therethrough that cooperates with the second surface of the printed circuit board to bound the first channel.

6. The device of claim 5, further comprising a vent layer cover coupled to the vent layer and defining an opening therethrough in fluid communication with the first channel, wherein the vent layer cover cooperates with the cutout and the second surface of the printed circuit board to bound the first channel.

7. The device of claim 1, wherein the first channel comprises a tortuous configuration.

8. The device of claim 2, wherein the first channel limits contact between contaminants and the circuit thereby enabling the device to be autoclaved.

9. The device of claim 2, further comprising:

a set of switch contacts arranged in a predetermined pattern on the first surface of the printed circuit board; and a set of selectively activatable switches disposed within the spacer layer, each one of which is positioned relative to a respective one of the set of switch contacts for activating the respective one of the set of switch contacts.

10. The device of claim 9, wherein the second channel includes a set of cutout portions configured to overlay the set of switch contacts and a set of pathways extending between the set of cutout portions such that the set of pathways do not intersect the circuit.

11. The device of claim 9, further comprising a cover layer coupled to the spacer layer to retain the set of selectively activatable switches in position within the spacer layer.

12. The device of claim 9, wherein the set of selectively activatable switches comprise dome switches.

13. The device claim 12, wherein the dome switches comprise gold plated stainless steel domes.

14. The device of claim 10, wherein the first channel and the second channel cooperate to limit contact between contaminants and the circuit thereby enabling the device to be autoclaved.

15. A device comprising:

a printed circuit board having a first surface and a second surface;

a circuit traversing only the first surface of the printed circuit board;

a selectively activatable switch positioned relative to the circuit, wherein the circuit board includes a first channel formed in the second surface of the circuit board and in fluid communication with the selectively activatable switch.

16. The device of claim 15, further comprising a resilient keypad including a button positioned relative to the selectively activatable switch for activating the selectively activatable switch.

17. A method of venting comprising:

displacing air within a cavity of a switch by:

moving the air through one or more channels formed in a layer defining cut-outs in fluid communication with the cavity;

moving the air though an opening formed in a printed circuit board, the layer being positioned at a first side of the printed circuit board; and moving the air through a venting channel and into the surrounding environment via an opening located adjacent to an end of the venting channel, the venting channel being positioned at a second, opposite side of the printed circuit board.

18. The method of claim 17, wherein the venting channel comprises a tortuous configuration.

* * * * *